US005227555A

United States Patent [19]

Rhoe et al.

[11] Patent Number: 5,227,555

[45] Date of Patent: Jul. 13, 1993

[54] PRODUCTION OF GASOLINE FROM LIGHT HYDROCARBONS

[75] Inventors: Andrei Rhoe, New York, N.Y.; Kenneth J. Gwozdz, Pompton Plains, N.J.

[73] Assignee: ABB Lummus Crest Inc., Bloomfield, N.J.

[21] Appl. No.: 217,945

[22] Filed: Jul. 12, 1988

[51] Int. Cl.[5] ..... C07C 1/00; C10G 35/06

[52] U.S. Cl. ..... 585/322; 585/323; 585/412; 585/415; 585/467; 208/135; 208/63; 208/64

[58] Field of Search ..... 585/322, 323, 412, 415, 585/467; 208/135, 63, 64

[56] References Cited

U.S. PATENT DOCUMENTS

| | | | |
|---|---|---|---|
| 2,001,907 | 5/1935 | Ipatieff | 583/322 |
| 2,287,935 | 6/1942 | Grosse et al. | 585/322 |
| 2,343,870 | 3/1944 | Kaplan | 585/323 |
| 2,381,466 | 8/1945 | Schulze et al. | 585/322 |
| 2,399,751 | 5/1946 | Mattox | 585/322 |
| 2,403,879 | 7/1946 | Schulze et al. | 585/322 |
| 2,892,876 | 6/1959 | Haensel | 585/322 |
| 2,921,013 | 1/1960 | Mullineaux | 585/322 |
| 3,494,971 | 2/1970 | Fenske | 585/323 |
| 3,623,973 | 11/1971 | Tarhan | 585/323 |
| 3,729,409 | 4/1973 | Citen | 208/135 |
| 3,761,389 | 9/1973 | Kollmann | 585/323 |
| 4,035,430 | 7/1977 | Dwyer et al. | 585/322 |
| 4,049,539 | 9/1977 | Van et al. | 585/322 |
| 4,053,388 | 10/1977 | Bailey | 585/322 |
| 4,078,990 | 3/1978 | Brennan et al. | 585/322 |
| 4,157,293 | 6/1979 | Plank et al. | 585/417 |
| 4,157,355 | 6/1979 | Addison | 585/322 |
| 4,157,950 | 6/1979 | Frilette et al. | 208/135 |
| 4,158,025 | 6/1979 | Addison | 585/322 |
| 4,304,657 | 12/1981 | Miller | 208/135 |
| 4,354,049 | 10/1982 | Ball et al. | 208/135 |

*Primary Examiner*—Patrick P. Garvin
*Assistant Examiner*—E. D. Irzinski
*Attorney, Agent, or Firm*—Elliot M. Olstein; Raymond J. Lillie

[57] ABSTRACT

A process for the production of gasoline from a light hydrocarbon feed. The feed is catalytically aromatized to produce an effluent containing aromatics and olefins with the aromatics and olefins being subjected to alkylation to produce a gasoline product with a higher octane rating.

20 Claims, 3 Drawing Sheets

PRODUCTION OF GASOLINE FROM LIGHT HYDROCARBONS

This application relates to the production of gasoline and more particularly to the production of gasoline from light hydrocarbons.

It has been known in the art to subject a hydrocarbon feedstock, in particular a light hydrocarbon feedstock, to catalytic conversion conditions to produce aromatics and olefins. For example, U.S. Pat. Nos. 3,813,330 and 3,827,968 disclose the conversion of a feed comprising olefins to an aromatics fraction and an olefin fraction. U.S. Pat. No. 3,853,749, discloses the conversion of a hydrocracked lube oil having at least 1 wt. % of paraffins to aromatics. U.S. Pat. No. 3,845,150 discloses the conversion of a hydrocarbon feed comprising saturated hydrocarbons and olefins to aromatics. U.S. Pat. No. 4,354,049 discloses the production of aromatic hydrocarbons from a $C_2$ to $C_{12}$ aliphatic hydrocarbon feedstock, whereas U.S. Pat. No. 4,590,323 discloses the conversion of a feedstock which may comprise $C_2$ to $C_{12}$ alkanes to aromatics and aliphatics. A preferred catalyst which may be used in these processes is a zeolite catalyst, in particular a ZSM-5 type of catalyst. The preparation of ZSM-5 is disclosed in U.S. Pat. No. 3,702,886. Chen and Yan disclose the conversion of a light hydrocarbon feedstock in the presence of a ZSM-5 type catalyst to products which include aromatics and olefins through dehydrogenation and cyclization. N. Y. Chen and T. Y. Yan, "M2 Forming-A Process for Aromatization of Light Hydrocarbons," *Ind. Eng. Chem. Process Des. Dev.*, Vol. 25, pgs. 151–155 (1986). The Chen and Yan article also discloses that as one increases the LHSV. and thereby decreases the residence time of the feed in the catalyst bed, that there is an increase in the amount of olefins formed by the catalytic conversion of the hydrocarbon feed. The feed may include propene, n-pentane, n-hexane, napththas and light FCC gasolines.

The aromatic components produced by the processes disclosed in the above-identified references include benzene, toluene, and mixed xylenes, and $C_9$+ aromatics which are used as blending components in the manufacture of gasoline.

In accordance with an aspect of the present invention, a light hydrocarbon feed is catalytically aromatized to produce an effluent containing aromatics and olefins. Aromatics and olefin present in the effluent are subjected to catalytic alkylation to produce alkyl aromatics.

In a process for cyclization (aromatization) of light hydrocarbons to produce aromatics, olefins are also produced. In accordance with an aspect of the present invention, aromatics and olefins produced in the aromatization are subjected to alkylation conditions to produce alkyl aromatics. (As used herein an alkyl aromatic is an aromatic substituted with at least one alkyl group having at least 2 carbon atoms).

The light hydrocarbon feed which is subjected to catalytic aromatization may be comprised of one or more hydrocarbons and has a boiling temperature which generally does not exceed 400° F., and which most generally does not exceed 300° F. As representative examples of feeds there, may be mentioned light paraffins, olefins or naphthenes, e.g., n-pentane, n-hexane, n-octane, ethylene, propylene, etc. In general, refinery streams containing such materials are a convenient feed source; such as light ends from cracking or coking units, cracked gasoline. (e.g., FCC gasoline), pyrolysis gasoline, light or full range reformate, light or full range naphtha, Fisher-Tropsch gasoline, etc. The feed may be saturated, unsaturated or a blend of saturated and unsaturated materials.

The light hydrocarbon feed is converted in the presence of a catalyst which produces aromatics, and which also produces olefins. As known in the art, zeolite catalysts are effective for producing aromatics from light hydrocarbons. A preferred zeolite catalyst is ZSM-5 and in particular HZSM-5, which is the acidic form of ZSM-5, and which has been subjected to ammonium ion exchange.

Catalysts which are effective for converting light hydrocarbons to aromatics are well known in the art and no further details in this respect are deemed necessary for an understanding of the present invention.

The light hydrocarbons may be cyclized to aromatics at temperatures of from 200° C. to 700° C. with the temperature most generally being in the order of from 400° C. to 600° C. In general pressures are in the order of from 0.1 to 60 atm. In a preferred embodiment, the cyclization pressure is maintained at about the pressure for the subsequent alkylation. Liquid hourly space velocities may be from 0.1 to 100.

In the catalytic cyclization, both aromatics and olefins are produced. The production of aromatics is favored by longer residence times (lower space velocities) and higher temperatures. Olefin production is favored by shorter residence times. In accordance with a preferred embodiment, the residence time and temperature for the aromatization is selected to achieve a severity which provides a ratio of aromatics to olefins which is desired for the subsequent alkylation. Thus, for example, in general, it is preferred to effect the cyclization at a severity at which the effluent from the cyclization has an aromatic to olefin mole ratio of at least 3:1.

In some cases, in order to obtain the desired mole ratio of aromatic to olefin, the cyclization may be effected in two different reactors, with a portion of the feed in one reactor being cyclized at a severity which favors aromatic production and a part of the feed being cyclized in a second reactor at conditions which favors olefin production. By a proper proportioning of the feed and selection of severities it is possible to-achieve a desired mole ratio.

All or a portion of the aromatics present in the aromatization effluent and all or a portion of the olefins present in the aromatization effluent may be employed as a feed to a catalytic alkylation zone wherein the aromatics are alkylated by the olefin(s). The alkylation may be accomplished at conditions generally known in the art; e.g., a temperature of from about 150° F. to about 900° F., preferably from about 200° F. to about 600° F. and most preferably from about 200° F. to 450° F. The aromatic, fraction and the olefin fraction may be converted to alkylbenzenes at an LHSV of from about 2 to about 1,000, preferably from about 4 to about 100.

The alkylation may be effected at pressures of from 1 to 50 atm and preferably from 30 to 40 atm. The aromatic to olefin mole ratio may range from 1:1 to 40:1 and preferably the ratio is at least 3:1. Most generally, the ratio is in the order of from 3:1 to 10:1.

The mole ratio of aromatics to olefins as well as conditions are preferably selected to minimize polymerization of olefins and to produce an effluent in the gasoline range; e.g. 250° F. to 410° F.

Unconverted light aromatics, in particular benzene and toluene, may be recycled to the alkylation.

The effluent from the aromatization may be directly fed to the alkylation, or in the alternative one or more components may be separated therefrom prior to introduction into the alkylation zone. For example, the effluent may be treated to recover olefins and aromatics which are fed to the alkylation. The remaining components, as appropriate, may be recycled to the aromatization.

If all of the aromatization effluent is introduced into the alkylation zone, then the effluent from the alkylation zone is appropriately treated to recover gasoline product, as well as recycle components to both the aromatization reactor and the alkylation reactor.

It is also possible, in accordance with the present invention, to add aromatics and/or olefins to the alkylator from sources other than the effluent from the first stage catalytic aromatization.

Any one of a wide variety of alkylation catalysts may be employed including zeolite alkylation catalysts, in particular Y zeolites, aluminum chloride, supported phosphoric acid, silica-alumina, etc., with a zeolite alkylation catalyst being preferred. Such alkylation catalysts are known in the art and no further details are necessary for a complete understanding of the present invention.

The invention will now be described with respect to the drawings, wherein.

Figure 1:
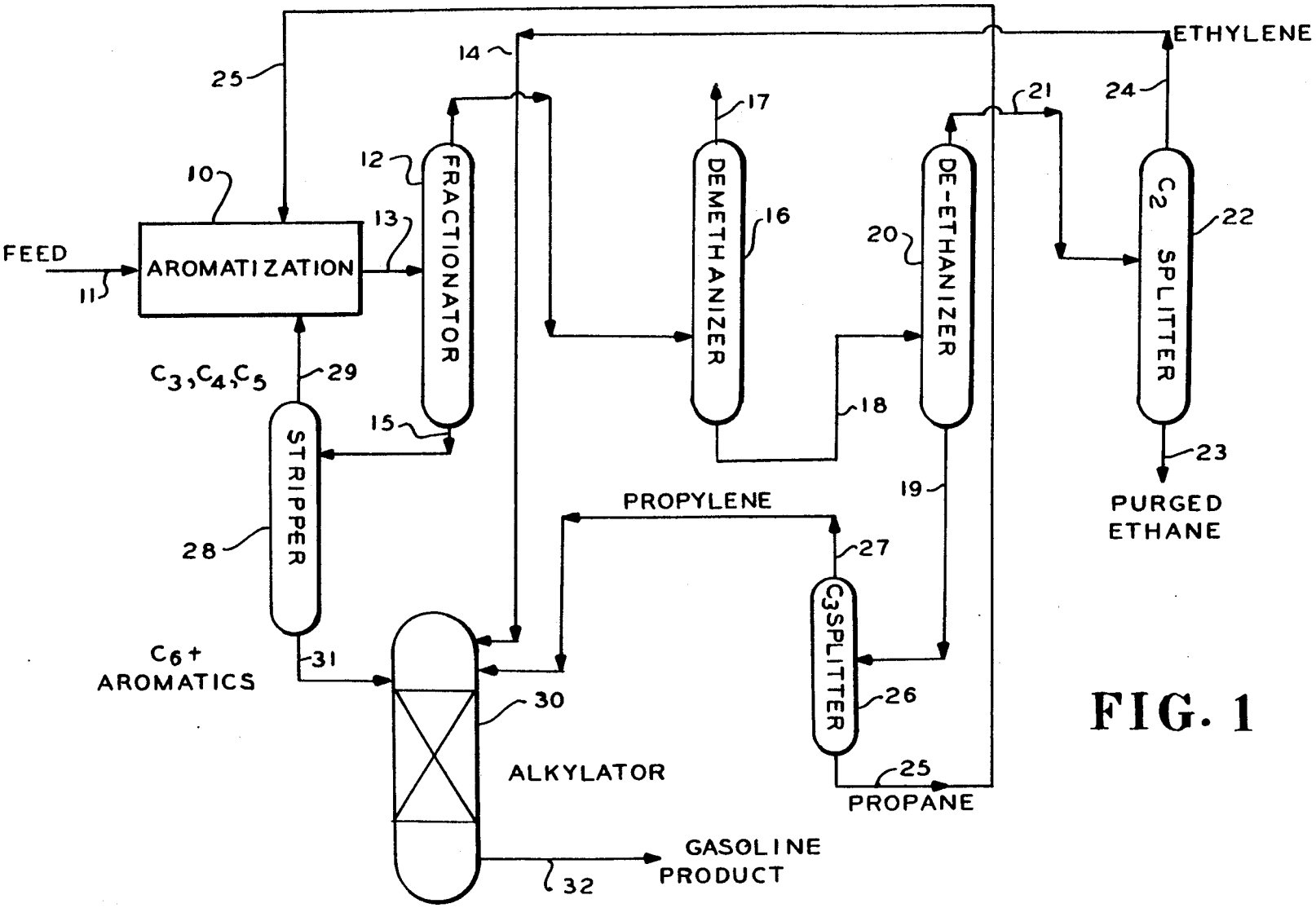
FIG. 1 is a schematic representation of an embodiment for producing gasoline in accordance with the invention.

Referring now to the drawings, a hydrocarbon feed in line 11 is passed to a catalytic aromatization reactor 10. The reactor 10 contains a catalyst, most preferably a zeolite catalyst such as HZSM-5. The catalyst may be a fixed bed although it is possible to use other forms; eg.. a fluidized bed. transport bed, etc. The feed in line 11 may be paraffins having at least two carbon atoms, naphthenes, or light FCC gasolines. Also, refinery streams rich in unsaturated hydrocarbons such as pyrolysis gasoline from a naphtha steam cracking process, unsaturated gases from a catalytic cracking process, catalytically cracked gasolines, and coker naphthas may be other feedstocks for this process.

When a saturated feed is employed, dehydrogenation of the feed is involved prior to aromatization. The dehydrogenation of saturated feeds is highly endothermic whereas if an olefinic feed is employed, the aromatization of the olefinic feed may be exothermic. Therefore, one can blend saturated and unsaturated hydrocarbons in the feedstock so as to make the aromatization reaction thermally neutral, or to produce various degrees of endothermicity or exothermicity, if desired.

The catalyst employed is preferably a monofunctional catalyst that brings about a number of consecutive acid-catalyzed reactions including conversion of olefinic and/or paraffinic molecules to small olefins (e.g.. ethylene and propylene) via acidic cracking and hydrogen transfer reactions, the formation of $C_2$–$C_{10}$ olefins via transmutation, oligomerization, cracking, and isomerization reactions, and aromatic formation, as in catalytic reforming, by cyclization and hydrogen transfer. The exact sequence of reactions will depend upon the specific feedstock and conditions employed.

During the catalytic conversion process in cyclization and dehydrogenation reactor 10, the liquid hourly space velocity (LHSV) of the feed passing through the reactor 10 and the temperature have an effect upon the make-up of the effluent.

In accordance with a preferred embodiment, it is desired that the catalytic conversion in reactor 10 be carried out at an LHSV and temperature to produce aromatics and olefins in a ratio favorable for the subsequent alkylation.

The effluent from the reactor 10 is withdrawn through line 13 and passed to fractionator 12. Fractionator 12, which may be operated as is known in the art, splits the effluent into an overhead stream containing $C_3$ and lighter hydrocarbons, including the olefins ethylene and propylene, as well as methane, ethane, and propane, and also a bottoms stream which contains aromatics (e.g., benzene, toluene, xylene, $C_9$+ aromatics) and some $C_3$, $C_4$, and $C_5$ hydrocarbons. The overhead stream is withdrawn through line 14, and the bottoms stream is withdrawn through line 15. The overhead stream in line 14 is passed to demethanizer 16, and the bottoms stream in line 15 is passed to stripper 28.

In stripper 28, the $C_3$, $C_4$, and $C_5$ hydrocarbons are stripped from the aromatics. Stripper 28 is operated as known in the art. The $C_3$, $C_4$, and $C_5$ hydrocarbons are withdrawn through line 29 and recycled to the reactor 10, whereas the aromatics, which contain at least six carbon atoms and include benzene, toluene, xylene, and $C_9$+ aromatics, are withdrawn through line 31.

The light hydrocarbon fraction in line 14 which is passed to demethanizer 16, is split in demethanizer 16 into a methane and lighter fraction withdrawn through line 17, and a bottoms fraction, which is withdrawn through line 18, and passed to de-ethanizer 20. Demethanizer 16 is operated as is known in the art.

The bottoms fraction in line 18 is passed to de-ethanizer 20, which is operated as is known in the art. An overhead fraction, which contains ethane and ethylene, is withdrawn through line 21, whereas a bottoms stream containing a heavier fraction, principally propane and propylene, is withdrawn through line 19.

The lighter overhead fraction in line 21 is passed to $C_2$ splitter 22, which is operated as is known in the art. In $C_2$ splitter 22, ethylene is separated and withdrawn through line 24, whereas a purged ethane product is withdrawn through line 23.

The heavier fraction in line 19 is passed to a $C_3$ splitter 26. In $C_3$ splitter 26, the heavier fraction is split into a propane stream, withdrawn through line 25, which is recycled to reactor 10, and a propylene fraction, withdrawn through line 27.

The aromatic fraction in line 31, the ethylene fraction in line 24, and the propylene fraction in line 27 are each introduced into alkylator 30. Alkylator 30 contains at least one bed, or stage, of an alkylation catalyst, preferably a zeolite alkylation catalyst. In addition to the aromatic feed in line 31, the ethylene feed in line 24, and the propylene feed in line 27, the feeds may be further enriched by the addition of aromatics and/or olefins from sources other than the aromatization and alkylation apparatus above described in order to achieve a desired product yield.

In alkylator 30, the aromatics are catalytically alkylated at conditions as hereinabove described. The alkylbenzenes are then withdrawn from the alkylator 30 as a desired gasoline product as illustrated by line 32. eg., a gasoline blending stock.

Figure 2:
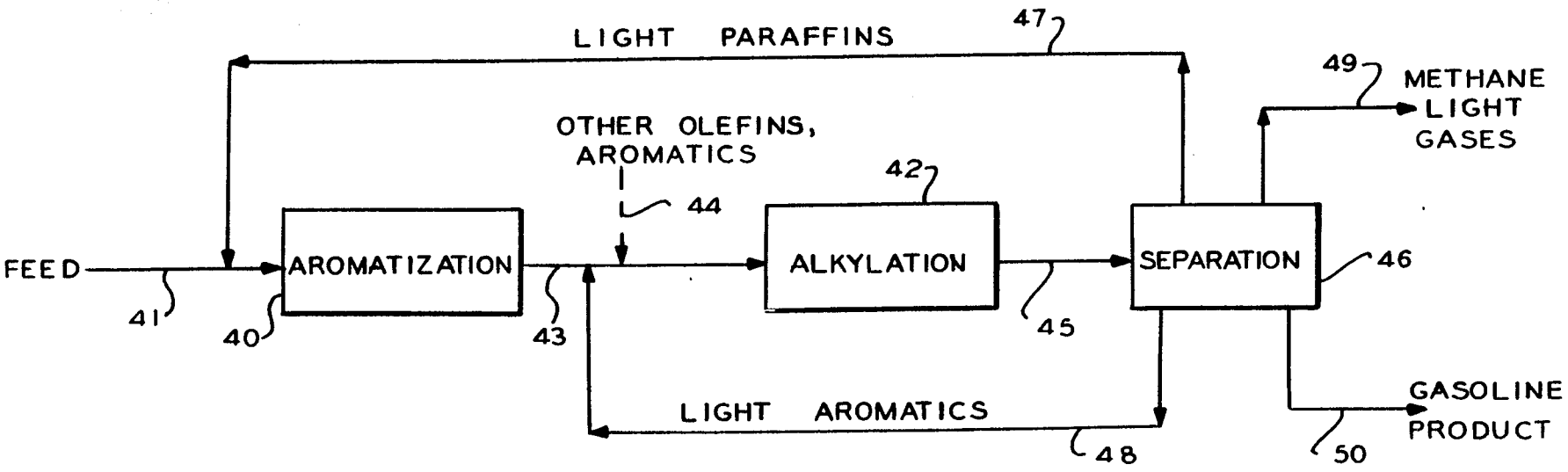
FIG. 2 is a schematic of a second embodiment of a process for the manufacture of gasoline in accordance with the present invention.

In an alternative embodiment shown in FIG. 2, a hydrocarbon feed in line 41 is passed to an aromatization zone 40 wherein the hydrocarbon feed is catalytically converted to aromatics and olefins under conditions as hereinabove described.

The entire effluent from the aromatization zone 40 is withdrawn from aromatization zone 40 through line 43 and passed to alkylation zone 42. Olefins and aromatics other than those produced in aromatization zone 40 may optionally be introduced through line 44 to the effluent in line 43 prior to the introduction of the effluent in line 43 into alkylation zone 42. The olefins and aromatics passed to alkylation zone 42 are subjected to alkylation conditions in the presence of an alkylation catalyst as hereinabove described.

The effluent from alkylation zone 42 is withdrawn through line 45 and passed to separation zone 46. Light paraffins which can be aromatized are withdrawn from separation zone 46 through line 47. The light paraffins in line 47 are passed to the hydrocarbon feed in line 41, and thereby recycled to the aromatization zone 40. Light aromatics (e.g., benzene and toluene) are withdrawn from separation zone 46 through line 48, and passed to the aromatization effluent in line 43. The light aromatics are thereby recycled to the alkylation zone 42.

Methane and other light gases withdrawn from separation zone 46 through line 49, whereas gasoline product is recovered through line 50. The gasoline product may be a gasoline blending stock as described above.

Figure 3:
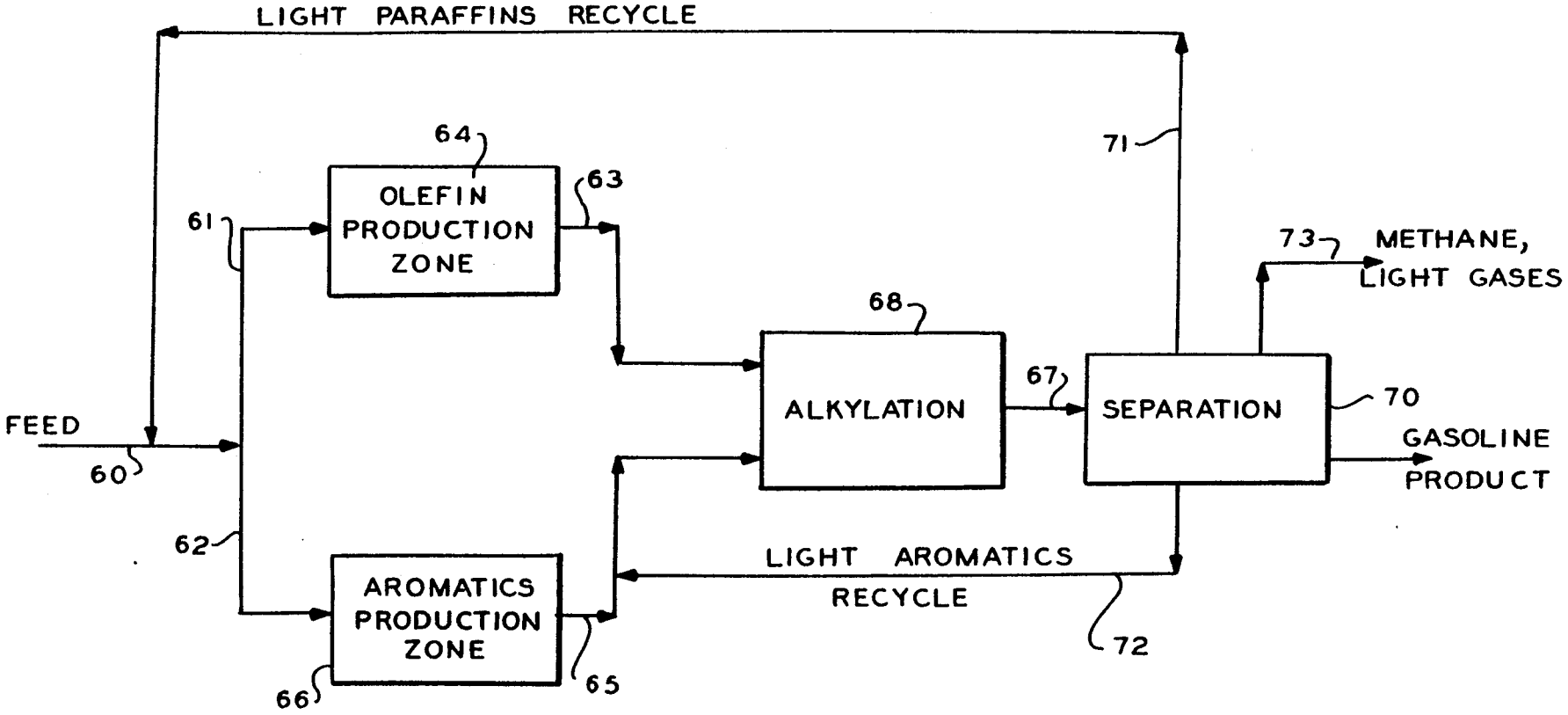
FIG. 3 is a schematic of a schematic of a third embodiment of a process for the manufacture of gasoline in accordance with the present invention.

In another alternative embodiment, as shown in FIG. 3, a light hydrocarbon feed in line 60 is split and/or proportioned into a first feed in line 61 and a second feed in line 62. The first feed in line 61 is passed to an olefin production zone 64 which is operated at conditions which favor olefin production, whereas the second feed in line 62 is passed to an aromatic production zone 66 which is operated at conditions which favor the production of aromatics. The amount of feed in line 60 may be proportioned into lines 61 and 62 so as to enable the production by zones 64 and 66 of a feed to an alkylation zone which has a desired molar ratio of aromatics to olefins. The effluent from zone 64, which favors olefin production, is withdrawn from zone 64 through line 63, and the effluent from zone 66, which favors aromatics production, is withdrawn through line 65. The effluents in lines 63 and 65 are both passed to alkylation zone 68, wherein the aromatics are alkylated with olefins in the presence of an alkylation catalyst at conditions as hereinabove described.

The effluent from alkylation zone 68 is withdrawn through line 67 and passed to separation zone 70. A light paraffin recycle stream is withdrawn from separation zone 70 through line 71 and is combined with the hydrocarbon feed in line 60, thereby enabling the light paraffins to be recycled to olefin production zone 64 or aromatic production zone 66. A light aromatics stream containing, for example, benzene and toluene, is withdrawn through line 72 and recycled to line 65, whereby the light aromatics recycle stream is combined with the effluent from aromatic production zone 66, which favors the production of aromatics. The light aromatics withdrawn from separation zone 70 are thereby recycled to the alkylation zone 68.

Methane and light gases are recovered from separation zone 70 through line 73, whereas a gasoline product is recovered through line 74. The gasoline product recovered through line 74 may be a gasoline blending stock as described above.

The alkylbenzenes which are produced by the present invention, which include multialkylated aromatics, may be used to make a better, or hiher octane gasoline. The present invention, therefore, is advantageous in that improved gasoline blending stock is produced from light hydrocarbons; i.e., a blending stock with a higher octane rating.

It is to be understood, however, that the scope of the present invention is not to be limited to the specific embodiments described above. The invention may be practiced other than as particularly described and still be within the scope of the accompanying claims.

What is claimed is:

1. A process for the production of a gasoline product from a light hydrocarbon feed comprising:

catalytically aromatizing a light hydrocarbon in an aromatization zone and producing effluent containing aromatics and olefins; and catalytically alkylating said at least a portion of said effluent from said aromatization zone and producing a gasoline product.

2. The process of claim 1 comprising aromatizing said hydrocarbon feed in the presence of a zeolite catalyst.

3. The process of claim 1 wherein said alkylating catalyst is a zeolite catalyst.

4. The process of claim 1 wherein said feed comprises naphthenes.

5. The process of claim 1 wherein said feed comprises light FCC gasolines.

6. The process of claim 1 comprising aromatizing said light hydrocarbon at a temperature of from about 200° C. to about 700° C.

7. The process of claim 1 comprising aromatizing said light hydrocarbon at a liquid hourly space velocity from abut 0.1 to about 100.

8. The process of claim 1 comprising catalytically alkylating said at least a portion of the effluent from said aromatization zone at a temperature of from about 150° F. to about 900° F.

9. The process of claim 8 wherein said catalytic alkylating temperature is from about 200° F. to about 600° F.

10. The process of claim 9 wherein said catalytic alkylating is at a temperature of from about 200° F. to about 450° F.

11. The process of claim 1 comprising catalytically alkylating said aromatic and said olefin at a liquid hourly space velocity from about 2 to about 1,000.

12. The process of claim 11 comprising catalytically alkylating said aromatic and said olefin at a liquid hourly space velocity from about 4 to about 100.

13. The process of claim 1 wherein said feed comprises one or more light hydrocarbons which have a boiling point which does not exceed about 400° F.

14. The process of claim 13 wherein said one or more light hydrocarbons have a boiling point which does not exceed about 300° F.

15. The process of claim 1 comprising catalytically aromatizing a light hydrocarbon in an aromatization zone to produce an effluent having an aromatics to olefin mole ratio of 1:1 to 40:1.

16. The process of claim 15 wherein said aromatics to olefin mole ratio is at least 3:1.

17. The process of claim 16 wherein said aromatics to olefin mole ratio is from 3:1 to 10:1.

18. The process of claim 1 comprising catalytically aromatizing a light hydrocarbon in two zones, and passing a first portion of sad light hydrocarbon feed to a first reaction zone, said first reaction zone being operated at conditions producing aromatics, and passing a second portion of said light hydrocarbon feed to a second reaction zone, said second reaction zone being operated at conditions producing olefins.

19. The process of claim 1 comprising alkylating the effluent from the aromatization zone.

20. The process of claim 1 comprising recovering olefins and aromatics from the effluent and catalytically alkylating sad olefins and aromatics.

* * * * *